United States Patent [19]

Howlett

[11] 4,047,388

[45] Sept. 13, 1977

[54] METHOD FOR COUPLING AXIALLY ALIGNED TUNNEL SECTIONS AND APPARATUS THEREFOR

[75] Inventor: James W. Howlett, Oakland, Calif.

[73] Assignee: Howlett Machine Works, Berkeley, Calif.

[21] Appl. No.: 701,344

[22] Filed: June 30, 1976

[51] Int. Cl.[2] ..... E21D 11/08

[52] U.S. Cl. ..... 61/45 R; 403/305

[58] Field of Search ..... 61/45 R, 84, 44, 43; 403/305, 307, 343

[56] References Cited

U.S. PATENT DOCUMENTS

| | | | |
|---|---|---|---|
| 2,135,812 | 11/1938 | Gray | 403/305 |
| 3,850,000 | 11/1974 | McBean | 61/45 R |
| 3,850,535 | 11/1974 | Howlett et al. | 403/305 |

*Primary Examiner*—Jacob Shapiro
*Attorney, Agent, or Firm*—Warren, Chickering & Grunewald

[57] ABSTRACT

A method for coupling together two generally axially aligned structures, preferably concrete tunnel sections, is disclosed. The method includes mounting coupling apparatus including coupling means having an outwardly facing socket with a tapered thread therein to a first structure, mounting a coupling tendon having a tapered threaded end dimensioned to mate with the socket to a second structure, coupling the tendon to the coupling means and applying an axial tension force to the tendon and coupling means. The method and apparatus enables coupling together of substantially misalignment structures which could not be accomplished if conventional cylindrical threads were employed.

4 Claims, 4 Drawing Figures

METHOD FOR COUPLING AXIALLY ALIGNED TUNNEL SECTIONS AND APPARATUS THEREFOR

BACKGROUND OF THE INVENTION

While the technology for the construction of tunnels for various end used is quite old and well-developed, it has received new emphasis as a result of tunneling requirements for rapid transit systems. The rapid transit systems in the Oakland-San Francisco Bay Area, Washington, D. C. and planned systems in areas such as Atlanta have all made or proposed to make widespread use of long tunnels underneath the urban and densely populated areas.

While such tunnels can be constructed and permanently supported by means of steel tunnel support structures, it has been demonstrated that reinforced concreate tunnels can be advantageously employed during construction and as permanent installations. The use of such reinforced concrete tunnels results in a substantial cost savings, and cost over-runs have plagued all of the rapid transit systems installed to date.

One of the problems connected with the use of concrete tunnel support structures is the manner by which the concrete tunnel sections are coupled together. The reinforced concrete tunnel is formed from a plurality of cylindrical sections which are coupled together to form a unit. In a typical installation each tunnel section might be 16 feet in diameter and 4 feet in axial length, and the sections must be effectively and efficiently coupled together as a single unit. For the purpose of ease of construction, each section is further broken down into segments which are initially brought into the tunnel as a portion of a cylinder, for example, one quarter of the cylindrical section, and then are assembled.

Attempts to simply bolt the concrete sections together have encountered substantial problems. Even when the tunnel is straight, the tunnel sections can become slightly misaligned, making it most difficult and tedious, and sometimes impossible, to use conventional coupling techniques, such as a bolt-together system. Additionally, most rapid transit tunnels have the further requirement that the tunnels must, on occasion, be curved. Such curves are not extreme, but typically on the order of one or two degrees in the axial misalignment between the adjacent tunnel sections which are 4 feet in length. This permanent misalignment is far in excess of what can be accommodated by conventional bolt-together systems.

OBJECTS OF THE INVENTION

Accordingly, it is an object of the present invention to provide a method and apparatus for coupling together structures such as concrete tunnel sections which can accommodate axial misalignment between adjacent sections.

Another object of the present invention is to provide a method and apparatus for coupling together structures such as concrete tunnel sections which can be used to align initially misaligned tunnel sections.

Another object of the present invention is to provide a method and apparatus for coupling together concrete tunnel sections which affords a substantial savings in time and cost, can be employed by relatively unskilled personnel, produces a very high-strength coupling between section, and will accommodate a wide variety of installations.

The method and apparatus of the present invention have other objects and features of advantage which will become apparent from or are set forth in detail in the following description of the preferred embodiments and the accompanying drawings.

SUMMARY OF THE INVENTION

The method for coupling together two structures, such as concrete tunnel sections, of the present invention includes, briefly, mounting a coupling means formed with an outwardly facing socket having a tapered thread therein to the first structure, mounting a coupling tendon formed with a tapered thread and dimensioned to mate with the socket to a second structure, coupling the tendon to the coupling means by rotating and advancing at least one of the tendon and coupling means, and applying an axial tension force thereto. The apparatus of the present invention includes an assembly of concrete tunnel sections with the improvement of the present invention being apprised, briefly, of the tunnel sections each having an axially extending bore formed for receipt of a tendon therein, and means for coupling the tendon sections together which is comprised of a tendon positioned in each bore and having tapered threaded ends, coupling means having oppositely facing tapered threaded sockets threadably mounted and cinched down on the tapered threaded ends, and anchor means mounted on the opposite ends of the tendons for support of axial tension forces.

DESCRIPTION OF THE PREFERRED EMBODIMENTS

Figure 1:
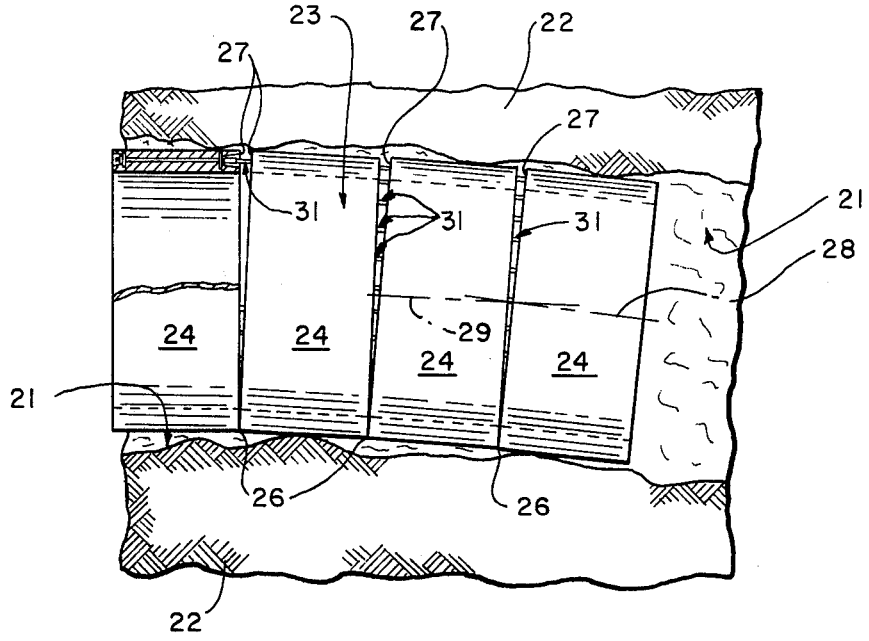
FIG. 1 is a fragmentary top plan view, partially broken away and in cross-section, showing an assembly of tunnel sections constructed in accordance with the present invention.

Referring now to FIG. 1, a tunnel, generally designated 21, can be seen to be formed in earth matter 22 and have positioned therein an assembly, generally designated 23, of concrete tunnel sections 24. Tunnel sections 24 are shown as cylindrical members, although it will be understood that they take other forms, depending upon the application and need to which they are put. As also will be seen from FIG. 1, tunnel 21 gradually curves or turns, and the array or assembly 23 of tunnel sections 24 accordingly has a gradually curving configuration. Since each of the tunnel sections is formed as a perpendicular section from a cylinder, the tunnel sections are shown to be abutting at their edges 26, while at edges 27 there is a gap to accommodate curvature of the tunnel. This curvature results in a misalignment between the adjacent tunnel sections as, for example, can be seen by comparison of the center lines 28 and 29 of the innermost, adjacent tunnel sections.

In order to couple the tunnel sections together as a unit, a plurality of coupling elements, generally designated 31, must be employed. Coupling elements 31 would typically be positioned about the periphery of the tunnel sections at about one to two foot intervals. The angle between adjacent tunnel sections 24 has been somewhat exaggerated for the purpose of illustration, for example to show the positioning of coupling elements 31. It should also be noted that in most tunnels, the gap between adjacent tunnel sections would be filled with sealing means such as conventional waterstop elements or elastomeric sealing compound.

Figure 2:
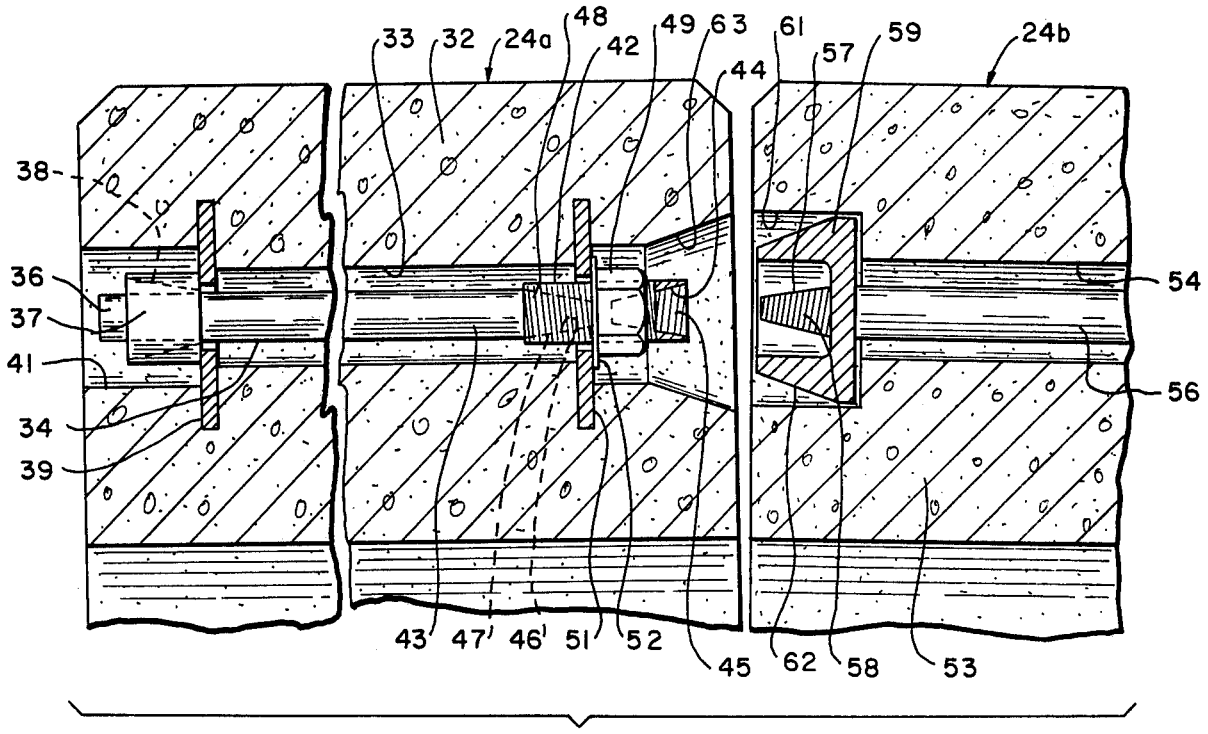
FIG. 2 is an enlarged, fragmentary, side elevational view, in cross-section, showing coupling apparatus constructed in accordance with the present invention in uncoupled condition.

Referring now to FIG. 2, the details of construction of the coupling system of the present invention which will accommodate and/or correct axial misalignment between adjacent sections can be set forth. A first structure or tunnel section 24*a* is shown to have a wall 32 formed with an axially extending bore 33 in which tendon 34 is positioned. Tendon 34 is secured at one end 36 by anchor means 37, which can take various forms but here is shown as an anchor having a convergently moveable wedge assembly 38 which grips the end 36 of tendon 39. Anchor means 37 bears upon a bearing plate 39 which is cast into wall 32, and the anchor means is shown as recessed in an enlarged cavity 41 dimensioned to accommodate the same.

In order to provide a structure which will accommodate axial misalignment between sections of the tunnels, coupling means 42 is shown as being mounted on the opposite end 43 of tendon 34. Coupling means 42 includes an outwardly facing socket 44 having a tapered threaded 45 formed therein. In the coupling shown in FIG. 2, coupling means 42 further is optionally formed with an oppositely facing tapered threaded socket 46 which is threadably mounted on tapered threads 47 on the end 43 of tendon 34. An addional optional feature shown in FIG. 2 is the provision of cylindrical threads 48 on the exterior surface of the coupling sleeve 42. Threadably mounted on threads 48 is a nut 49, which is formed to bear upon bearing plate 51 cast into concrete wall 32 through intermediate washer element 52.

There are numerous ways by which coupling means 42 can be mounted to the first tunnel section 24*a* other than that which is shown in FIG. 2, however, the structure of FIG. 2 has some substantial advantages which will be set forth in more detail hereinafter.

Mounted in close proximity to tunnel section 24*a* is a second tunnel section 24*b*, which can be seen to be slightly axially misaligned with respect to first tunnel section 24*a*. The second tunnel section 24*b* also preferably includes a concrete wall 53 having an axially extending bore 54 into which a coupling tendon 56 is mounted. Coupling tendon 56 is formed with a tapered end 57 having threads 58 formed therein and dimensioned to mate with tapered threaded socket 44 of coupling member 42. Positioning of tendon 56 in bore 54 is preferably accomplished by mounting collar means 59 or the like adjacent the tapered threaded end 57 so as to hold the tendon at about the center of bore 54. In this regard a cylindrical cavity 61 can be cast into the end of wall 53 concentrically with bore 54 so as to cooperate with collar 59 in the positioning of the tapered threaded end 57.

Figure 3:
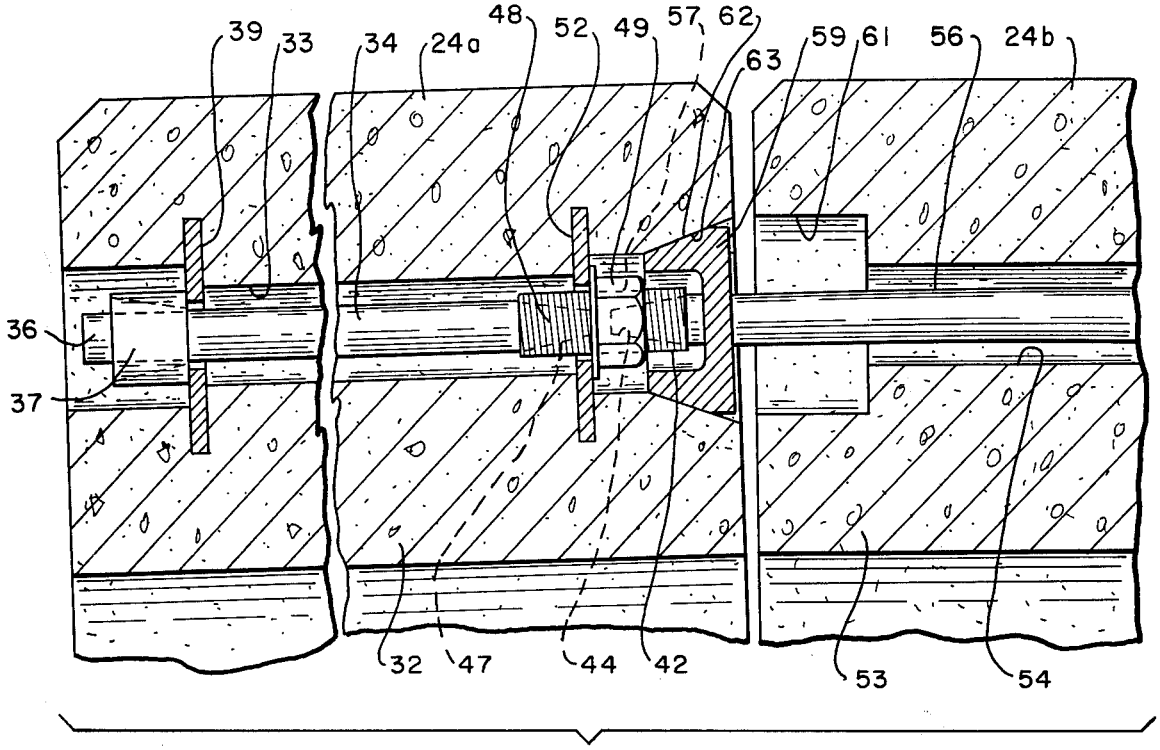
FIG. 3 is an enlarged, fragmentary, side elevational view, in cross-section, corresponding to FIG. 2 and showing the apparatus in coupled together condition.

Coupling of first tunnel section 24*a* and second tunnel section 24*b* can best be understood by reference to FIG. 3, which shows the apparatus in coupled condition. Coupling of coupling tendon 56 to coupling socket means 42 is accomplished by rotating at least one of the tendon and the coupling means and axially advancing at least one of the tendon and the coupling means to threadably engage end 57 with socket 44 until the end is cinched down in the socket. As shown in FIG. 3, tendon 56 has been axially advanced and rotated while socket 42 has remained stationary. As tendon 56 is advanced, the frusto-conical front surface 62 on collar 59 mates with a frusto-conical surface 63 cast in the end of wall 32 in the first tunnel section. The mating of surfaces 62 and 63 further insures positioning of threaded end 57 in socket 44.

Since the longitudinal axis of tendon 56 and the longitudinal axis of tendon 34 are misaligned or somewhat skewed, collar 59 will only position threaded end 57 in general, but not exact, alignment with threaded socket 44. The small diameter of the tapered threaded end 57, however, is much less than the large diameter end of socket 44 so that the collar will insure that the end of tendon 56 will be inserted in the opening of socket 44. Tendon 56 is then rotated until the threads 58 interengage with threads 45 and begin to pull the tendon into the socket. The mating tapered threads of the socket and tendon end will gradually pull the end of tendon 56 into alignment with the coupling sleeve 42 and tendon 34. This is accomplished by shifting the tendon in bore 54 and, to some degree, by bending the end of tendon 56. The ability of a tapered thread to enable the socket to cause the coupling tendon to conform to the axial direction of the socket is unique and not attainable when cylindrical threads are employed. If a cylindrical thread were to be employed and mated with a cylindrical socket for misalignment of even one or two degrees, the tendon could not be coupled to the socket.

It should be noted that tapered threads have been employed before in connection with coupling concreate reinforcing tendons, for example, in U.S. Pat. No. 3,415,552 and in U.S. Pat. No. 3,850,535, but the ability of such couplings to be employed to join axially misaligned members has not been previously recognized. U.S. Pat. No. 3,415,552 employs the tapered threaded sleeve and tendon end primarily to obtain full strength from the reinforcing rod coupling. While this advantage accrues from the method of the present invention, it is of secondary importance. Similarly, U.S. Pat. No. 3,850,533 is primarily concerned with the use of a tapered threaded coupling and an auxiliary union member when the tendons which are coupled together cannot be rotated. Tendon misalignment is not considered in either of these prior art patents.

After threaded end 57 is cinched down in socket 44, an axial tensioning force is applied to at least one of the tendon 56 and coupling 42. This is preferably accomplished by providing tensioning means (not shown) on the opposite end of tendon 56 from threaded end 57. Moreover, the tensioning means is preferably in the form of another coupling sleeve and tensioning nut which bear upon a bearing plate cast into the end of the second tunnel section 24*b*. Thus, the opposite end of tendon 56 is preferably formed as a tapered threaded end on which a sleeve of the same structure as coupling sleeve 42 is mounted with a threaded exterior surface on which a nut is further mounted. The nut may then be cinched down against the bearing plate in the same way that nut 49 is cinched down against bearing plate 52 so as to tension tendon 34. In this way, tendon 56 is tensioned and pulled against coupling 42, with the tension loads being supported by the second concrete tunnel section 24*b*. The application of a tension force to tendon 56 after its coupling to coupling means 42 can be used to create a high-strength coupling between the adjacent tunnel sections. Additionally, the support of the tension forces on structure 24b can result in a pulling or movement of tunnel section 24b into closer axial alignment with tunnel section 24a in the event that such alignment is desired. Thus, the method of the present invention can be used to lock the tunnel sections together in a misaligned orientation to accommodate a curve, as is shown in FIG. 1, or can be used to pull the tunnel sections into better axial alignment to insure that the tunnel is straight. In this regard, while coupling means 37 has been shown as an anchor means having a convergently acting wedge assembly, it will also be understood that anchor means 37 can take the form of a coupling sleeve 42 with a nut 49 threaded on the exterior surface thereof and formed to bear upon bearing plate 39. If desired, therefore, the entire anchoring and tensioning of concrete sections together to form a unit can be accomplished by forming the tendons 34 with tapered threaded ends and using double-ended coupling sleeves 42 with their tapered threaded sockets to act as anchor means and further to enable tensioning of the tendons. In this regard, it should also be noted that sufficient axial tensioning for the purpose of coupling the concrete sections together can be readily achieved by the use of a threaded nut, and it is not normally necessary to generate extreme axial tension forces through the use of a jacking means or the like.

Figure 4:
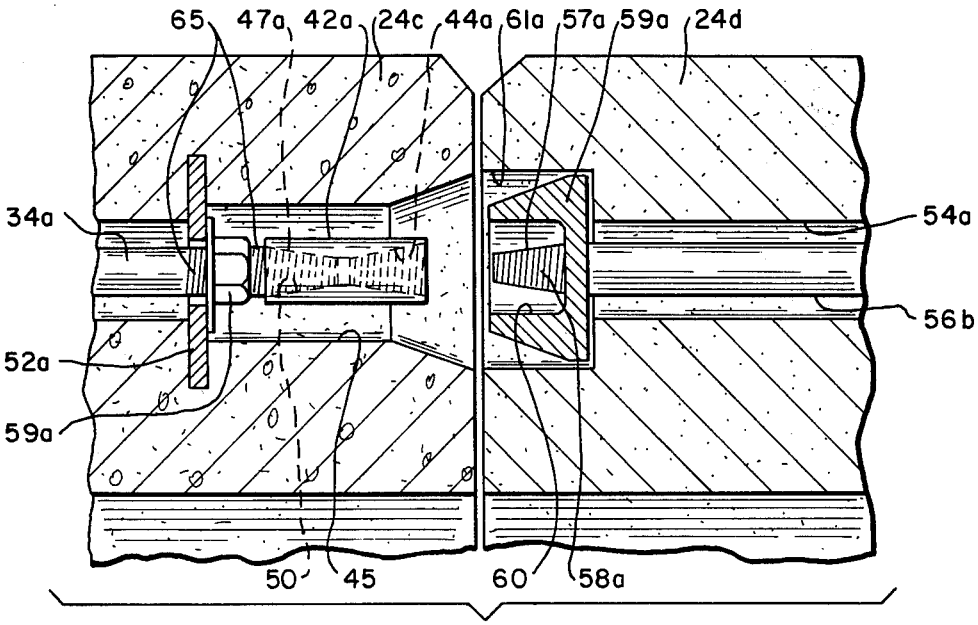
FIG. 4 is an enlarged, fragmentary, side elevational view, in cross-section, of an alternative embodiment of the apparatus of FIG. 2.

In FIG. 4 an alternative embodiment of the coupling apparatus of the present invention is shown which is suitable for use in practicing the method of the present invention. Concrete tunnel section 24c is mounted in close proximity to tunnel section 24d, and in this case, the tunnel sections are in closer alignment than was illustrated in FIGS. 1 through 3. Mounted in bore 54a is a coupling tendon 56a having a tapered end 57a on which a thread 58a is formed. The threaded tapered end of tendon 56a is held proximate the center of cylindrical cavity 61a by collar means 59a. Collar means 59a can be formed of a plastic such as polyethylene and is slidably mounted on tendon 56a with a cavity 60 dimensioned for receipt of the coupling sleeve means therein.

In a manner analogous to FIGS. 2 and 3, a coupling sleeve means 42a is preferably mounted to tunnel section 24c by mounting on a tendon 34a which extends through an opening in bearing plate 52a and has a tapered threaded end 47a which mates with a tapered threaded socket 50 in the coupling means. Oppositely facing tapered threaded socket 44a is positioned to receive the tapered threaded end 57a of coupling tendon 56a.

In the modified apparatus of FIG. 4, however, nut 59a is mounted directly on a cylindrically threaded portion 65 of tendon 34a. Thus, instead of providing threads 48 on the exterior surface of the coupling means 42, threads are formed in a portion of the tendon for receipt of the tensioning nut 59a. The threaded portion 65 of the tendon will reduce the diameter of the tendon which is capable of holding the axial tension loads, and accordingly, when the apprach of FIG. 4 is employed, tendons 34a and 56a are preferably of a larger diameter than would be required for the coupling of FIGS. 2 and 3. Additionally, the axial distance to which the bearing plate 52a is recessed from the end of the tunnel section is increased, as is the length of cylindrical cavity 45.

The method for coupling the adjacent tunnel sections together is substantially identical, regardless of the apparatus employed. The first tendon is secured at its outermost end, the coupling sleeve is cinched down on the first tendon, and the first tendon is then tensioned by the tensioning nut. The second or coupling tendon is then advanced into the socket in the coupling sleeve and cinched down. A tensioning nut and another coupling sleeve is then mounted on the opposite end of the coupling tendon, and then the tensioning nut is cinched down to apply a tensioning force to the coupled assembly. The next tunnel section is then positioned proximate the preceding one and the sequence is repeated.

What is claimed is:

1. A method for coupling together a first structure and a second structure while positioned in close proximity to each other and while positioned in slightly misaligned relation, said method including the steps of mounting coupling means to said first structure, mounting a coupling tendon to said second structure, coupling said tendon to said coupling means and thereafter applying an axial tension force to at least one of said tendon and said coupling means while supporting said tension force by said structures, wherein the improvement in said coupling method permitting coupling of misaligned structures is comprised of the steps of:

providing said coupling means as a member having a tapered socket with a tapered thread therein;

providing said tendon with a tapered threaded end dimensioned to mate with said socket; and coupling said tendon means to said coupling means by threadably engaging said tapered threaded end of said tendon with said tapered thread in said socket until said end is cinched down in said socket.

2. The method for coupling together two structures as defined in claim 1 wherein, said tendon is rotatably mounted and is mounted for axial advancement toward said coupling means in an axially extending bore in said second structure.

3. A method for coupling together and axially aligning two concrete tunnel sections initially mounted in a slightly axially misaligned relation with at least one of said sections being movable with respect to the remainder of said tunnel sections, comprising the steps of:

a. positioning a first tunnel section for coupling of a second tunnel section thereto, said first tunnel section having coupling means formed with an outwardly facing tapered threaded socket anchored thereto with said threaded socket oriented to face parallel to the longitudinal axis of said first tunnel section;

b. positioning a second tunnel section proximate and in general axial alignment but in slight misalignment with the longitudinal axis of said tunnel section, said second tunnel section being formed with an axially extending bore formed for receipt of a coupling tendon therethrough;

c. mounting a coupling tendon through said bore in said second tunnel section, said coupling tendon being formed with a tapered threaded end dimensioned to mate with said socket in said coupling means and being mounted to juxtapose said threaded end with said threaded socket;

d. rotating said coupling tendon in said bore to thread said threaded end into said coupling means and cinch said coupling tendon down in said coupling means; and e. thereafter, applying an axial tensioning force to said coupling tendon while supporting said tensioning force by said second tunnel section to cause the movable of said tunnel sections to be pulled into close abutting and axially aligned relation to the remainder of said tunnel sections.

4. In a generally axially aligned and coupled together assembly of concrete tunnel sections including a first tunnel section, a second tunnel section, and means coupling said tunnel sections together as a unit, the improvement comprising:

a. said tunnel section and said second tunnel section each being formed with an axially extending bore therein dimensioned for receipt and rotation of a coupling tendon therein, and the bores of said tunnel sections being positioned in general axial alignment; and b. said means for coupling said tunnel sections together being comprised of:

i. a coupling tendon positioned in each of said bores in said tunnel sections, the coupling tendons being formed with juxtaposed tapered threaded ends;

ii. coupling means formed with oppositely facing tapered threaded sockets with said sockets threadably mounted and cinched down on said juxtaposed tapered threaded ends to couple said tendons together; and iii. anchor means mounted on each of said tendons on ends of said tendons opposite said coupling means, said anchor means gripping said tendon and bearing upon said tunnel sections for support of axial tension forces in said tendons by said tunnel sections.

* * * * *

UNITED STATES PATENT AND TRADEMARK OFFICE

CERTIFICATE OF CORRECTION

PATENT NO. :4,047,388

DATED :September 13, 1977

INVENTOR(S) :JAMES W. HOWLETT

It is certified that error appears in the above-identified patent and that said Letters Patent are hereby corrected as shown below:

In column 2, line 56, after "they" insert ---may---.

In column 3, line 32, delete "threaded" and insert ---thread---.

In column 4, line 35, delete "concreate" and insert ---concrete---.

In claim 3, column 6, line 53, after "said" and before "tunnel" insert ---first---.

In claim 4, column 7, line 11, after "said" and before "tunnel" insert ---first---.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*